US006196662B1

(12) United States Patent
Voelker et al.

(10) Patent No.: US 6,196,662 B1
(45) Date of Patent: Mar. 6, 2001

(54) METHOD TO UTILIZE A FIXED ELEMENT PRINT HEAD TO PRINT VARIOUS DOT SPACINGS

(75) Inventors: Martin C. Voelker, East Hampton, CT (US); Norman L. Milliard, Hampton, NH (US)

(73) Assignee: Accent Color Sciences, Inc., East Hartford, CT (US)

( * ) Notice: Subject to any disclaimer, the term of this patent is extended or adjusted under 35 U.S.C. 154(b) by 0 days.

(21) Appl. No.: 09/033,329

(22) Filed: Mar. 2, 1998

(51) Int. Cl.[7] ..... B41J 2/15
(52) U.S. Cl. ..... 347/40; 347/12; 347/37
(58) Field of Search ..... 347/40, 12, 9, 347/43, 20, 24, 47, 10, 8, 37

(56) References Cited

U.S. PATENT DOCUMENTS 4,364,060 * 12/1982 Jinnai et al. ..... 347/40
4,972,270 * 11/1990 Kurtin et al. ..... 347/40
5,621,440 * 4/1997 Takahashi ..... 347/12
5,675,365 * 10/1997 Becerra et al. ..... 347/9
5,921,691 * 7/1999 Kabayashi et al. ..... 400/634

* cited by examiner

*Primary Examiner*—N. Le
*Assistant Examiner*—Lamson D. Nguyen
(74) *Attorney, Agent, or Firm*—Alix, Yale & Ristas, LLP

(57) ABSTRACT

A print head has a plurality of linearly arranged, spaced apart print elements. The print head is positioned in a printing assembly at an angle to the process path of the print receiving documents. The angle of the print head is preselected whereby the distance between adjacent print elements in the direction orthogonal to the process direction is a preselected print resolution. The print head is then operated whereby the print elements fire multiple times as the document moves the preselected print resolution beneath the print head.

10 Claims, 2 Drawing Sheets

METHOD TO UTILIZE A FIXED ELEMENT PRINT HEAD TO PRINT VARIOUS DOT SPACINGS

FIELD OF THE INVENTION

This invention relates to the field of printing apparatus. More particularly this invention relates to using a print head having a fixed printing element spacing to print at alternative print resolutions.

BACKGROUND OF THE INVENTION

It is well-known in the field of printing to print indicia onto moving documents by use of a print head having printing elements with fixed spacing. These printing elements are typically ink jets. Printing resolution is generally limited to the fixed printing element spacing of the particular print head. The printing resolution is defined in pixels or dots per unit length. Conventionally, this is expressed as dots per inch (dpi).

In a conventional printing apparatus, a print head is oriented generally orthogonally to the process direction of the paper path. Increases in print resolution are limited by the ability to more closely space the printing elements of the print head. To overcome the limitations on the fixed spacing of the printing elements, a prior printing apparatus has the print head oriented at an angle to the process direction of the paper path. The angled orientation of the print head operatively decreases the relative distance between adjacent printing elements of the print head in the direction orthogonal to the process direction. An example of a printing apparatus having an angled print head is disclosed in U.S. patent application Ser. No. 08/552,789 entitled "A Printer Assembly", filed Nov. 3, 1995, which is incorporated by reference herein.

Conventional printing apparatus having the print head generally perpendicular to the process direction of the document are operated to print generally simultaneously along the entire length of the print head. Therefore, each line of pixels orthogonal to the process direction, or scan line, has the pixels printed simultaneously.

Conventionally, the print head is operated whereby data is "loaded" into the print head. In a monochrome print head, the data is for a particular printing element to print a pixel, the pixel being an ink dot or a space. The print head is then at the appropriate time triggered to simultaneously "fire" the printing elements, whereby all of the printing elements are simultaneously triggered to perform the particular data loaded therein. The desired image is thereby generated by a combination of ink dots and spaces printed by the printing elements.

In an angled print head arrangement, each pixel of a particular scan line is printed sequentially instead of simultaneously. The first pixel of a scan line on a document is printed by the first printing element of the angled print head. A second pixel is printed adjacent the first pixel by the second printing element as the document is moved in a process direction. The document then continues to move in the process direction whereby the third pixel can be printed adjacent the second pixel by the third printing element, etc.

In an actual printer operating environment, the angled print head functions to simultaneously print multiple scan lines, the number of scan lines being simultaneously printed generally equal to the number of printing elements of the print head. As a document moves in the process direction, the scan line furthest in the process direction is being printed by the last printing element of the print head, while simultaneously the first printing element of the print head is printing the newest scan line. Therefore, in the process direction, the first printing element initially prints the first pixel of a new scan line. Simultaneously, the final printing element completes printing the final pixel on the final scan line that has been previously sequentially printed on by each previous printing elements of the print head.

Operationally, in a simplified example having four printing elements on an angled print head, the printing procedure is as follows for printing four scan lines. The first printing element prints the first pixel of the first scan line. The document is then moved in the process direction. The second printing element at a later time prints a second pixel adjacent the first pixel on the first scan line. Simultaneous with the printing of the second pixel, the first printing element prints the first pixel of the second scan line. In the next subsequent step, the document is again moved in the process direction, the third printing element prints the third pixel of the first scan line simultaneously with the second printing element printing the second pixel of the second scan line and the first printing element printing the first pixel of the third scan line. The printing process is continued until the entire image is produced on the document.

In order to ensure that each scan line is straight, it is preferable that the distance in the process direction between adjacent printing elements be an integer number of scan lines. Integer spacing of adjacent printing elements in the process direction assure that each subsequent pixel printed on a particular scan line is adjacent to the previously printed pixel. The integer spacing is preferable due to the firing of all of the printing elements simultaneously to print multiple scan lines. Non-integer spacing between the printing elements in the process direction sacrifices line straightness in order to allow a particular resolution or dpi perpendicular to the process direction. The displacement of a particular pixel from a line through the first pixel of a scan line and orthogonal to the process direction is referred to as pixel placement error.

SUMMARY OF THE INVENTION

Briefly stated, the invention is a method for operating a print head having fixed printing element spacing and oriented at an angle to the process direction to print various printing resolutions. The method of operation minimizes pixel placement errors resulting from the geometry of the printing elements of the print head. In the method, a print head having fixed printing element spacing is oriented at an angle to the process direction of a printing apparatus continuously moving a document past the print head in the process direction. The angle of the print head to the process direction is selected based on the spacing of the fixed printing element spacing and the desired printing resolution orthogonal to the process direction. The method improves print quality in the process direction by overcoming the loss in print quality inherent in non-integer spacing of print elements in the process direction.

In the preferred embodiment of the invention, the angled print head performs multiple firings per scan line to permit more precise positioning of pixels on a particular scan line. The multiple firing of the print head per scan line allows for an orientation of the print head whereby the distance between adjacent printing elements in the process direction is not an integer value while still providing an improved quality of printing. The resolution or dpi measured perpendicular to the process direction can be varied while employing a print head having a fixed element spacing. In other words, a particular print head having a fixed printing element spacing can be employed to print a range of dpi's wherein the resulting spacing of the printing elements in the process direction are not integer values, while simultaneously maintaining an improved level of print quality and line straightness.

In operation, the print head is angled whereby the distance between the printing elements perpendicular to the process direction is the reciprocal of a preselected dpi. The distance in the process direction between the first printing element and each subsequent printing element is divided by the spacing of the printing elements orthogonal to the process direction. The distance in the process direction from the first printing element to each subsequent printing element is then calculated from the geometry of the print head. This calculation determines the absolute displacement for each subsequent printing element. This absolute displacement is measured in units of scan lines or pixels. The fractional or decimal remainder for each absolute displacement is the calculated pixel error for each corresponding print element if the print head was fired once per scan line.

The print head in the method of the invention is operated to have multiple sub-firings per scan line. The combination of multiple sub-firings of the print head per scan line, and the continuous movement of the document past the print result in the ability to print on the document in fractions of scan lines. The sub-firings for a scan line and a throughput rate of a document are therefore synchronized to provide the preselected print resolution. The fraction of a scan line that can be printed is 1/N wherein N is the number of firings of the print head per scan line. The calculated pixel error for each printing element subsequent to the first printing element is rounded to the nearest decimal equivalent of 1/N of the scan line.

An optimal firing of each subsequent printing element can therefore be selected to reduce the particular pixel placement error corresponding to that printing element. The maximum pixel displacement error by use of the method will be ±½N of a pixel wherein N is the number of sub-firings of the print head per scan line. The more sub-firings per scan line, the smaller the pixel placement error by use of the method and the straighter the printed scan line.

The number of sub-firings per scan line is limited by the maximum frequency at which data can be loaded into the print head and fired. The number of sub-firings per scan line is further limited by the throughput rate of the print receiving document in the process direction. For a given print head, the lower the throughput rate of the document, the greater the number of sub-firings that can be performed per scan line and therefore the greater the improvement in printing quality.

The method of the invention can be further employed to improve print quality by correcting for individual printing variations of particular printing elements in the process direction. A printing element can, due to mechanical variation or other factors, emit an ink stream at a non-orthogonal angle to the document surface. Therefore, the resulting printed pixel can be offset in the process direction from the calculated position. An empirical test can be performed to determine if particular printing elements have a printing discrepancy or inherent pixel placement error in the process direction. The printing discrepancy can be combined with the calculated pixel error for a particular printing element, and thereby additionally corrected by selection of the optimal sub-firing time for the particular printing element. Similarly, the jet velocity can vary among the ink jet printing elements of a particular print head. Variations in jet velocity result in printing discrepancies in the process direction because the document is continuously moving past the print head. Fast jets will print early in the process direction and slow jets will print late in the process direction. Furthermore, the distance that a particular ink stream from a printing element travels can vary based upon the geometry of the transport surface of the document. Again, by empirical measurement, these discrepancies arising from variation in travel distance of ink streams from particular printing elements can be measured. The pixel placement errors from varying travel distances of the ink are corrected by addition to the calculated pixel error and recalculation of the preferred sub-firing of the corresponding printing element.

In a further embodiment of the invention the print head has multiple print head drive circuits corresponding to the sub-firings. The print head is angled as indicated above to obtain the correct resolution or dpi orthogonal to the process direction of the printing apparatus. A placement error table is also further generated. The placement error is then employed to select the preferred sub-firing for each printing element to position the corresponding pixel to reduce pixel placement error. The reduced pixel placement error is accomplished by having multiple sub-firing times, each sub-firing with its own print head drive circuit.

The particular printing elements with like corrections are physically connected to a single appropriate print head drive circuit and simultaneously fired. As an example, particular printing elements of a print head may all operate on the first sub-firing of the respective scan lines to provide the appropriate pixel placement correction. Therefore, these particular printing elements are all controlled by the same print head drive circuit for simultaneous operation. Other particular printing elements of the print head may provide the appropriate pixel placement correction by being operated on the third sub-firing a scan line. Therefore, these printing elements are simultaneously operated by a second drive circuit. At the operational limit, each printing element can be arranged to have a corresponding independent drive circuit for individual firing of each printing element at the appropriate time to reduce print error. These embodiments also allow a single loading of the print data to the print head.

An object of the invention is to provide an apparatus and method for employing a print head having fixed printing element spacing to produce printing higher resolution printing or closer spacing between pixels than the fixed element spacing of the print head.

A further object of the invention is to provide a method of operating an angled print head to produce improved print quality for a range of print resolutions.

Another object of the invention is to provide a method of operating a print head at an angle to the process direction of a print apparatus for improved pixel placement, and thereby, higher print quality.

A still further object of the invention is to provide a method of operating an angled print head to have multiple sub-firings per scan line.

These and other objects of the invention will become apparent from review of the specification and the drawings.

DESCRIPTION OF THE PREFERRED EMBODIMENT

Figure 1:
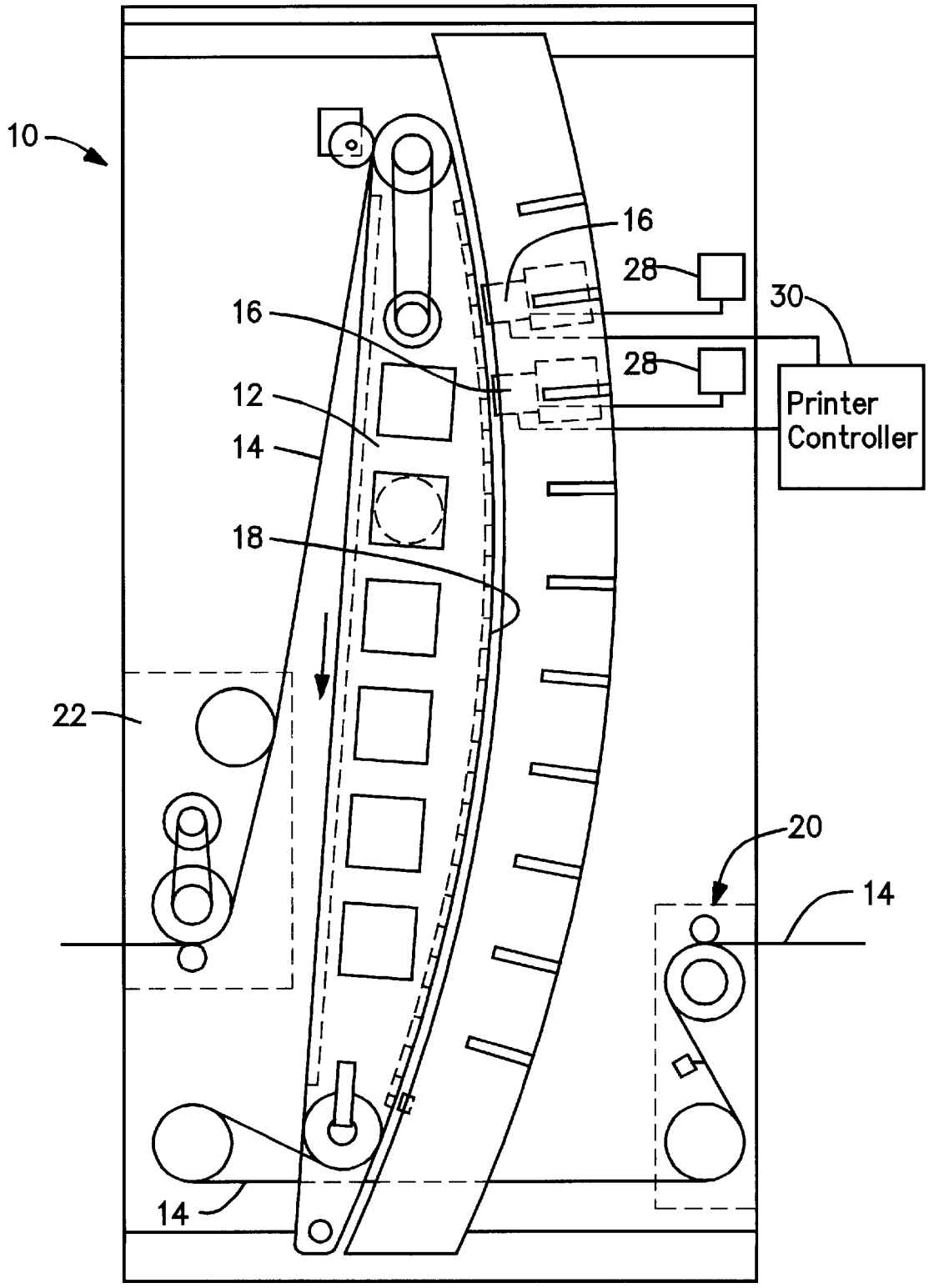
FIG. 1 is a plan view, partially in phantom of a printer apparatus employing the method of the invention.

With reference to FIG. 1, a printing apparatus 10 operable by the method of the invention has a curvilinear conveyor 12 for moving a web 14 of documents of printable material past a series of print heads 16. The web 14 contains preprinted documents for receiving additional color accents from the print heads 16. The method of the invention is also readily employable to print onto separate or cut sheet documents, and/or blank documents. The conveyor 12 defines a curvilinear print surface 18 on which the web 14 is moved. The web 14 is directed onto the conveyor 12 by an input assembly 20 and removed from the conveyor 12 by an output assembly 22. The web 14 is moved past the print heads 16 in a process direction P.

Each print head 16 has multiple linearly arranged printing elements 24. Each printing element 24 is formed of an ink jet, and is operable to print a pixel of wax based ink onto the web 14. The print heads 16 preferably employ a wax based ink for high speed color accent printing. Each print head 16 is supplied from an ink reservoir 28 containing the liquid ink. The method of the invention is further employable with other forms of print heads employing other forms of printing elements and/or other types of inks.

The print heads 16 are controlled by a print controller 30. The print controller 30 loads "data" to each of the printing elements 24 of the print head 16 for the printing of pixels. The "data" for a pixel for each printing element 24 of a single color print head 16 is typically a "one" to print an ink dot or a "zero" to not print when the print head is fired. The printing elements 24 are operated simultaneously to perform the loaded "data" when the print head 16 is fired. The print controller 30 is typically a computer or other similarly microprocessor-controlled apparatus.

Figure 3:
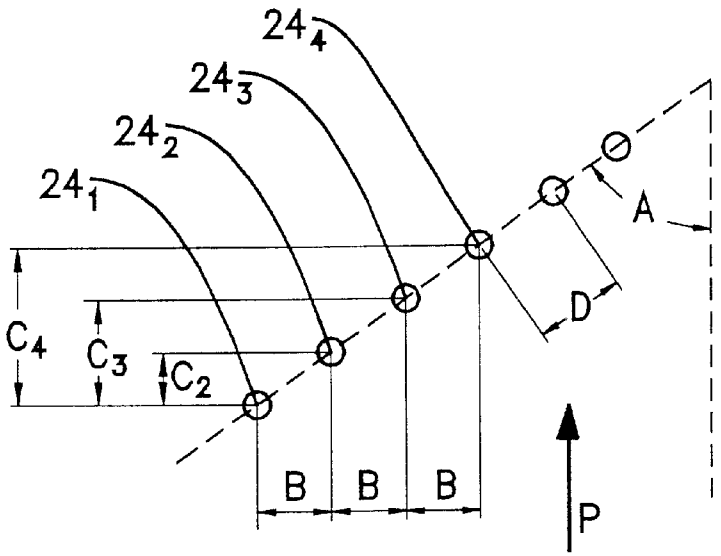
FIG. 3 is an enlarged partial frontal view of the printing elements of the print head of FIG. 2.
Figure 2:
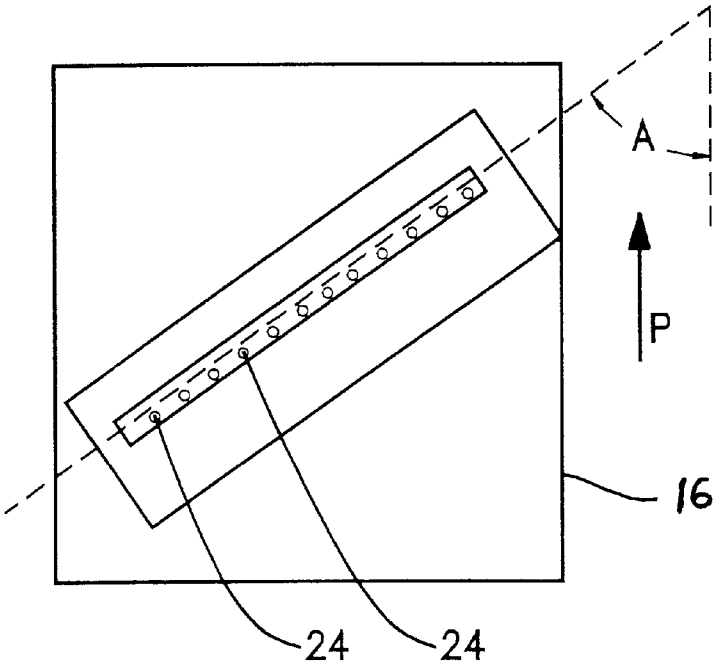
FIG. 2 is an enlarged detailed frontal view of a print head of FIG. 1.

The printing elements 24 are linearly arranged and equidistantly spaced by an element spacing D. (See FIGS. 2 and 3.) The print head 16 is oriented at an angle A to the process direction P. The angle A is selected such that the print resolution distance B between adjacent printing elements 24, measured orthogonal to the process direction P, has the desired image resolution. In other words, the resolution distance B between adjacent printing elements 24 measured orthogonal to the process direction is the reciprocal of the selected dpi. A process direction printing element to printing element spacing C in the process direction can then be determined from the print head geometry. The process direction element to element spacing C is measured or calculated from the first or initial printing element $\mathbf{24}_1$ to each subsequent individual printing element $\mathbf{24}_2$, $\mathbf{24}_3$, . . . $\mathbf{24}_n$ on the print head 16. Therefore, from printing element $\mathbf{24}_1$ to printing element $\mathbf{24}_2$ is process direction element spacing $C_2$. The distance from the initial printing element $\mathbf{24}_1$ to printing element $\mathbf{24}_3$ is element to element distance $C_3$. The process direction element spacing C is calculated for each printing element 24 of the print head 16.

The process direction element spacing C is divided by the resolution distance B (or dpi) to determine an absolute displacement. The absolute displacement is measured in units of pixels or scan lines. Most typically, the absolute displacement value for any one printing element 24 is not an integer, but instead involves a remainder. This remainder, again in units of pixels, is referred to as the calculated pixel error. The calculated pixel error is the displacement that would occur for that particular printing element 24 during the printing process. This displacement is from a line extending from the first pixel orthogonal to the process direction.

An example of calculating the pixel placement error is illustrated below in a printing error table for a print head with ten printing elements. The printing elements have an element to element spacing D of 0.011 inches. The print head is oriented at the angle A to the process direction to result in a resolution distance B of 0.00417 inches, or a printing resolution of 240 dots per inch. The process direction spacing C is calculated from the printing element 1 to each subsequent printing element and then divided by 1/240 to result in the absolute displacement of each subsequent printing element. The absolute displacement is measured in units of pixels or scan lines.

| Printing element Number | Absolute Displacement (C/B) | Calculated Pixel Placement Error | Scan Line Data | Scan Line Sub-Firing | Actual Printing Error | Offset In Scan Lines |
|---|---|---|---|---|---|---|
| 1 | 0 | 0 | 0 | 0 | 0 | 0 |
| 2 | 2.443 | 0.443 | 2 | 2.5 | 0.057 | 2 |
| 3 | 4.887 | 0.887 | 5 | 5.0 | 0.113 | 3 |
| 4 | 7.330 | 0.330 | 7 | 7.25 | 0.080 | 2 |
| 5 | 9.773 | 0.773 | 9 | 9.75 | 0.023 | 2 |
| 6 | 12.216 | 0.216 | 12 | 12.25 | 0.034 | 3 |
| 7 | 14.660 | 0.660 | 14 | 14.75 | 0.090 | 2 |
| 8 | 17.103 | 0.103 | 17 | 17.0 | 0.103 | 3 |
| 9 | 19.546 | 0.546 | 19 | 19.5 | 0.046 | 2 |
| 10 | 21.989 | 0.989 | 22 | 22.0 | 0.011 | 3 |

The absolute table displacement from printing element 1 to printing element 2 is 2.443. (See column 2.) Therefore, if printing element 1 prints a pixel and two scan lines later, printing element 2 prints a pixel, the second pixel will be displaced by 0.443 pixels from the line extending from the first pixel orthogonal to the process direction. With reference to column 3 of the table, the calculated pixel placement error ranges from generally 1/10 of a pixel to almost a full pixel.

The method of the invention reduces the calculated pixel error by multiple operation or sub-firing of the print head for each scan line. Due to the continual movement of the document and the multiple sub-firings of the print head 16 a pixel from a particular printing element can be positioned on fractions of a scan line. Operationally, a scan line is actually a unit of time the document takes to move one pixel in displacement beneath the print head. Therefore, multiple sub-firing of the print head is increasing the frequency of firing the print head in relation to the document velocity in the process direction.

With further reference to the table, the print head 16 is operated to sub-fire four times per scan line. Therefore, the print head 16 operates to have sub-firings 0.0, 0.25, 0.5, and 0.75 for scan line 0, sub-firings 1.0, 1.25, 1.50 and 1.75 for scan line 1, etc. The preferred sub-firing for each printing element can be determined by reference to the table. The absolute displacement for each printing element subsequent to the first printing element is rounded to the nearest sub-firing of a scan line. Operation of the printing element at the nearest sub-firing reduces the printing error. For example, the absolute displacement calculated for the second printing element is 2.443. The absolute displacement 2.443 is rounded to the sub-firing 2.5. Therefore, the scan line data of scan line 2, indicated in column 4, is fired at 2.5 to improve the pixel placement. For the other sub-firings of scan line 2 at 2.0, 2.25 and 2.75, printing element 2 is loaded with zero data to therefore not print when fired. At 2.5, printing element 2 is loaded with the correct data for scan line 2. By firing printing element 2 at 2.5 in contrast to 2.0, the actual printing error is reduced to 0.057 pixels as indicated in column 6 of the table, from the calculated pixel error of 0.443. The greatest printing error obtained from use of the method is ±½N pixels, wherein N is the number of firings per scan line. Therefore, for the example given, the largest actual printing error is ±⅛ or ±0.125 pixels. This is a substantial improvement over the calculated pixel error ranging from 0.103 to almost a full pixel.

As can be seen by further reference to the above table, the print head 16 simultaneously prints over an interval of 22 scan lines. In the example provided however, printing is performed on only 10 of the 22 scan lines at any given firing of the print head. Therefore, adjacent pixels of a scan line are not typically printed by immediately subsequent printings of scan lines, but are instead printed a spaced number of scan lines apart. The spacing of the scan lines is indicated in column seven of the chart. In operation of the print head of the example, the first printing element of the print head prints at the first sub-firing of every scan line. The data to be printed adjacent that first pixel will be delayed. In column 7 of the table above, the pixel to be printed by printing element 2 adjacent the pixel printed by printing element 1 is delayed two scan lines after the first initial firing by the printing element 1. (See column 7.) The printing of the second pixel is two scan lines or nine sub-firings after the printing of the first pixel. The image to be generated by the print head is thereby formed.

The more sub-firings of the print head per scan line, the smaller the pixel placement error, and therefore, the more improved the resulting image. The number of sub-firings of the printing elements per scan line is limited by the maximum frequency at which data can be loaded to the print head and the print head subsequently fired or operated. The number of sub-firings per scan line is also related to the rate of movement of the document in the process direction. A higher throughput rate or velocity of the document in the process direction decreases the potential number of sub-firings per scan line.

The method of the invention can be implemented in a further embodiment wherein the data is loaded to the print head 16 and only selected printing elements 24 are fired at the appropriate time by multiple drive circuits. The print head 16 selectively operates sub-sets of the printing elements 24 in contrast to firing all of the printing elements simultaneously. In this embodiment of the method, the print head is angled as indicated above to obtain the correct print resolution in the direction orthogonal to the process direction. The placement error table is also calculated as indicated above. The placement error table is then employed to select the correct sub-firing on which to load the data to reduce the calculated pixel placement error. The printing elements 24, with the same sub-firing corrections, are physically connected to a common drive circuit to be fired simultaneously at the time that reduces placement error.

For example, with reference to the above table, printing elements 1, 3, 8 and 10 each have the smallest pixel placement error when operated at the first sub-firing of a scan line. Therefore, these particular printing elements are interconnected to have a first common drive circuit. Similarly, printing elements 2 and 9 each fire at the third sub-firing of the scan line. Printing elements 2 and 9 are interconnected with a second common drive circuit to fire simultaneously. Therefore, printing elements 1, 3, 8 and 10 are operated simultaneously as a first sub-set of the entire array of printing elements. Printing elements 2 and are operated simultaneously as a second sub-set of the entire array of printing elements. In general, the number of drive circuits required will be equivalent to the number of firings per scan line. In operational environments without limitations on the number of drive circuits, each printing element is individually driven by a single corresponding drive circuit. Therefore, each printing element is individually fired to correct the total calculated pixel error. Under these circumstances, the actual resulting printing error can be reduced substantially to zero.

The method of the invention can further correct for performance pixel placement errors by individual printing elements in the process direction. These performance placement errors can be due to variations in jet velocity among individual printing elements, printing element misalignment, and/or spacing between a printing element and the document transport surface. The individual performance pixel placement errors are empirically measured for each particular print head. The measured performance pixel placement errors are added or subtracted to the calculated absolute placement value. The absolute placement values are then re-compared to the nearest sub-firing for the most improved pixel placement. Therefore, a particular printing element can be fired early or late to correct not only for the geometrical error resulting from the angled print head, but also for performance pixel placement errors as a result of manufacturing or other operational variations. The same adjustments can be performed for pixel placement errors arising from variations in the document transport surface.

While preferred embodiments of the present invention have been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What is claimed is:

1. A method for operating a printing apparatus having a stationary print head with a plurality of linearly aligned printing elements having a fixed printing element-to-adjacent printing-element spacing D and oriented at a predetermined angle A to a process direction along which a document to be printed is fed, whereby said spacing D and said angle A define a scan line spacing B between adjacent elements orthogonal to the process direction, said scan line spacing B being less than said spacing D, and a process spacing C between adjacent elements in the process direction, the printing elements operable to discharge printing media at a predetermined printing frequency N, the method comprising a series of arithmetic and logic operations including:

dividing said process spacing C by said scan line spacing B to determine an integer with remainder wherein the remainder defines a discharge placement error as a fraction of the scan line spacing B;

determining a discharge correction from said placement error and the printing frequency N;

discharging printing media from said first printing element on the document; and discharging printing media on said document from said second printing element, said discharge of printing media from said second printing element delayed in time from said discharge of printing media from said first printing element, commensurate with said discharge correction.

2. A method for operating a printing apparatus having a stationary print head with a plurality of linearly spaced apart adjacent printing elements, a controller programmed according to a particular print image to be applied to a document for firing the print head at selected time intervals whereby a firing signal is delivered at said time intervals to each printing element simultaneously such that in response to each firing signal each printing element sometimes discharges a quantity of ink and sometimes refrains from discharging a quantity of ink, onto a document continuously moving in a uniform process direction beneath the print head, the method comprising:

orienting the plurality of printing elements at an angle to the process direction thereby defining a predetermined printing-element-to-printing-element orthogonal spacing perpendicular to the process direction and a printing-element-to-printing-element process spacing in the process direction;

moving each document at a predetermined throughout velocity in the process direction under the print head whereby said velocity defines a scan line time interval for the document to move a scan line distance in the process direction equal to said printing element orthogonal spacing; and firing said print head at said selected time intervals which are shorter than said scan line time interval, whereby said print head is fired a plurality of times per scan line time interval as said document moves in the process direction.

3. The method of claim 2, wherein said selected time intervals are uniform and the print head is fired N times during the movement of the document a distance equal to said scan line distance; and each printing element discharges ink no more than once while the print head fires N times.

4. The method of claim 3, wherein the print head contains at least ten printing elements and N is at least four.

5. The method of claim 3, wherein the controller includes N driver circuits for the print head, each driver circuit connected to a subset of the printing elements, and the step of firing the print head N times during movement of the document one scan line includes firing each driver circuit once to discharge ink from all the printing elements connected to the fired driver circuit.

6. The method of claim 3, further including the steps of measuring variations in ink discharge characteristics of each printing element of the print head;

discharging ink from each printing element during a selected one of the N firings commensurate with said variations of each printing element discharge characteristics.

7. The method of claim 2, wherein when any one of the printing elements discharges ink, any adjacent printing element refrains from discharging ink.

8. The method of claim 7, wherein said selected time intervals are uniform and the print head is fired N times during the movement of the document a distance equal to said scan line distance; and each printing element discharges ink no more than once while the print head fires N times.

9. The method of claim 8, wherein the print head contains at least ten printing elements and N is at least four.

10. The method of claim 9, further including the steps of measuring variations in ink discharge characteristics of each printing element of the print head;

discharging ink from each printing element during a selected one of the N firings commensurate with said variations of each printing element discharge characteristics.

* * * * *